US007549562B2

(12) United States Patent
Wu et al.

(10) Patent No.: US 7,549,562 B2
(45) Date of Patent: Jun. 23, 2009

(54) NAIL PUSHER LOCATING DEVICE FOR MAGAZINE ASSEMBLY

(75) Inventors: Yi-Tsung Wu, Taipei Hsien (TW); Lien-Wei Tsai, Taipei Hsien (TW); Chi-Sheng Huang, Taipei Hsien (TW); Marco Laubach, Wheeling, IL (US)

(73) Assignees: De Poan Pneumatic Corp., Taipei (TW); Robert Bosch Tool Corporation, Mount Prospect, IL (US)

( * ) Notice: Subject to any disclaimer, the term of this patent is extended or adjusted under 35 U.S.C. 154(b) by 102 days.

(21) Appl. No.: 11/856,689

(22) Filed: Sep. 17, 2007

(65) Prior Publication Data

US 2009/0072001 A1 Mar. 19, 2009

(51) Int. Cl.
*B25C 1/00* (2006.01)
*B25C 1/04* (2006.01)

(52) U.S. Cl. ..... 227/120; 227/109; 227/119; 227/127; 227/128

(58) Field of Classification Search ..... 227/120, 227/109, 119, 127, 128
See application file for complete search history.

(56) References Cited

U.S. PATENT DOCUMENTS 3,612,378 A * 10/1971 Pabich et al. ..... 227/8
3,720,364 A * 3/1973 Maestri ..... 227/109
3,797,723 A * 3/1974 Perkins et al. ..... 227/109
4,197,974 A * 4/1980 Morton et al. ..... 227/8
4,463,888 A * 8/1984 Geist et al. ..... 227/109
4,815,647 A * 3/1989 Chou ..... 227/109
5,813,588 A * 9/1998 Lin ..... 227/109
6,644,530 B2 * 11/2003 Chen ..... 227/109
6,644,531 B2 * 11/2003 Yamamoto et al. ..... 227/120
6,837,412 B2 * 1/2005 Lamb ..... 227/18
6,938,812 B2 * 9/2005 Miller et al. ..... 227/120

* cited by examiner

*Primary Examiner*—Brian D Nash

(57) ABSTRACT

A nail pusher locating device for a magazine assembly has a nail pusher slidingly disposed in the magazine assembly; and a first elastic element between the magazine assembly and the nail pusher for driving the nail pusher to move toward a top end of the magazine assembly. The nail pusher has at least one bended-shaped guiding groove. The guiding groove has an entrance, an exit, and a capturing notch, opening to the top end, and a ridge protruding from an inner sidewall thereof, opposite to the capturing notch. The nail pusher further has a guiding flange slantwise extending to the entrance. The magazine assembly has a sway arm pivotally disposed at a tail end thereof, which has at least one guiding pole corresponding to the guiding flange. In addition, a second elastic element is provided between the tail end and the sway arm.

13 Claims, 9 Drawing Sheets

NAIL PUSHER LOCATING DEVICE FOR MAGAZINE ASSEMBLY

BACKGROUND

The present invention relates to a nail pusher locating device for a magazine assembly of a nail gun, and particularly relates to a configuration of a nail gun, which can locate and release a nail pusher slidingly received in the magazine assembly.

Typical pneumatically nail gun includes a nail pusher slidingly received therein, which can be driven by a spring disposed between an end of the magazine assembly and the nail pusher, and then moves toward a forepart of the magazine assembly. Thus, the nail pusher can one by one feed the plurality of nails received at the forepart of the magazine assembly to a hitting nose in the gun body of the nail gun, where the nails are driven into the workpiece. When the plurality of nails are used up, the nail pusher is generally located at a tail end of the magazine assembly for loading another plurality of nails into the magazine assemble from the top of the magazine assembly or the tail end thereof. After that, the pusher is released, it can then push and drive the another plurality of nails into the hitting nose again.

As shown in U.S. Pat. No. 6,938,812, a nail pusher positioned at a tail end of a magazine assembly is shown. A swingable shaft is pivotally provided at a tail end of the magazine assembly, which has a hook. A nail pusher has a groove formed at one sidewall corresponding to the hook of the swingable shaft, which is perpendicular to a moving direction of the nail pusher and opens to a side of the magazine assembly. Thus, when the nail pusher is pushed to the tail end of the magazine assembly and is released, the hook can slide into the groove along the sidewall to locate the nail pusher; and when the nail pusher is pushed to the tail end of the magazine again, the hook breaks away under a pushing force to release the nail pusher.

However, when the nail gun or the magazine assembly falls to the ground or hits a rigidly object, such as a wall, a tempestuously shake is produced between the magazine assembly and the nail pusher. Thus, the hook produces a sideward vibration and easily breaks away the groove, which leads an unstable location of the nail pusher.

BRIEF SUMMARY

An example nail pusher locating device for a magazine assembly has a nail pusher slidingly disposed in the magazine assembly; and a first elastic element between the magazine assembly and the nail pusher for driving the nail pusher to move toward a top end of the magazine assembly. The nail pusher has at least one bended-shaped guiding groove. The guiding groove has an entrance, an exit, and a capturing notch, opening to the top end, and a ridge protruding from an inner sidewall thereof, opposite to the capturing notch. The nail pusher further has a guiding flange slantwise extending to the entrance. The magazine assembly has a sway arm pivotally disposed at a tail end thereof, which has at least one guiding pole corresponding to the guiding flange. In addition, a second elastic element is provided between the tail end and the sway arm, for driving the guiding pole to move from the entrance to the exit.

Through the above described configuration, when the nail pusher is pushed to the tail end of the magazine assembly and is released, the guiding pole can slide into the capturing notch along the slant flange, the entrance, and one side of the ridge, for locating the nail pusher. When the nail pusher is pushed to tail end of the magazine assembly and is released again, the guiding pole can slide to the exit along another side of the ridge to release the nail pusher. Thus, the stability of the nail pusher is improved.

In addition, the number of the guiding groove can be plurality formed at two opposite outer sides of the nail pusher and the number of the guiding pole can also be plurality, opposite to each other.

In an alternate embodiment, the number of the guiding groove can be plurality formed at two opposite inner sides of the nail pusher and the number of the guiding pole can also be plurality, opposite to each other.

In one aspect, the ridge partitions the inner sidewall of the guiding groove to form a front stopping notch and a rear stopping notch, opening to the tail end of the magazine assembly.

In another aspect, the front stopping notch has a first slant surface slantways extending to the entrance.

In a further another aspect, the capturing notch has a second slant surface slantways extending to the corresponding front stopping notch.

In a further another aspect, the rear stopping notch has a third slant surface slantways extending to the capturing notch.

In a further another aspect, the exit has a fourth slant surface, inward oblique, slantways extending to the corresponding rear stopping notch.

In a further another aspect, the second elastic element drives the guiding pole to move to the fourth slant surface.

In another alternate embodiment, the ridge partitions the inner sidewall of the guiding groove to form a stopping notch, opening to the tail end of the magazine assembly.

In one aspect, the entrance has a first front slant surface, inward oblique, slantways extending to the ridge.

In another aspect, the entrance has a second front slant surface, inward oblique, slantways extending to the capturing notch.

In a further another aspect, the exit has a rear slant surface, inward oblique, slantways extending to the corresponding rear stopping notch.

In a further another aspect, the second elastic element drives the guiding pole to move to the corresponding rear slant surface.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
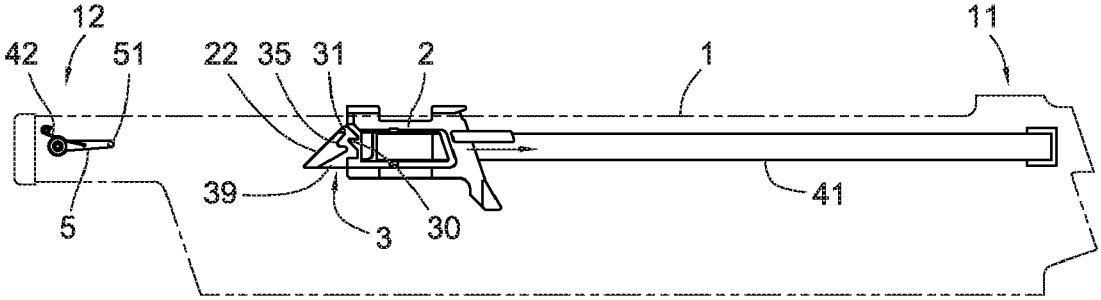
FIG. 1 is an assembly view of a magazine assembly according to a first embodiment of the present invention, having a nail pusher.
Figure 2:
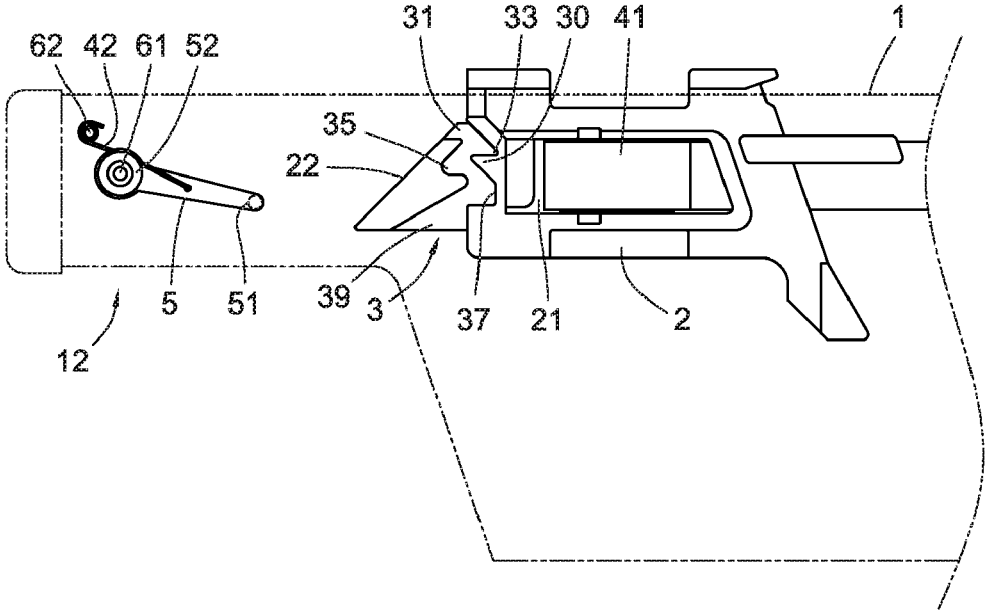
FIG. 2 is a partially enlarged view of the magazine assembly of FIG. 1.
Figure 3:
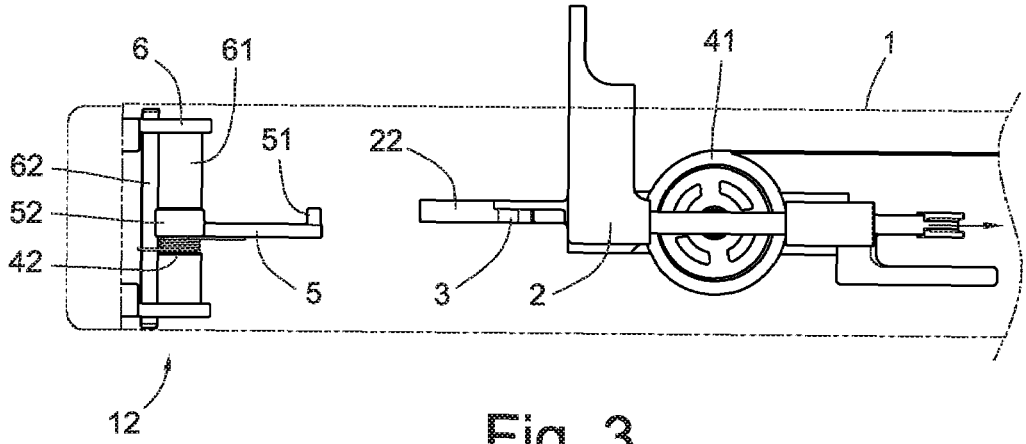
FIG. 3 is a side view of a part of the magazine assembly of FIG. 2.

FIGS. 1-3 disclose a locating device for a nail pusher of a magazine assembly according to a first embodiment of the present invention. The nail pusher 2 is provided in the magazine assembly 1 of a pneumatic nail gun, and a first elastic element 41 is provided between the magazine assembly 1 and the nail pusher 2. The first elastic element 41 may be a turbinate spring, one end being wrapped in a receiving aperture 21, and the other end being fixed at an inner sidewall of a top end of the magazine assembly 1.

Figure 4:
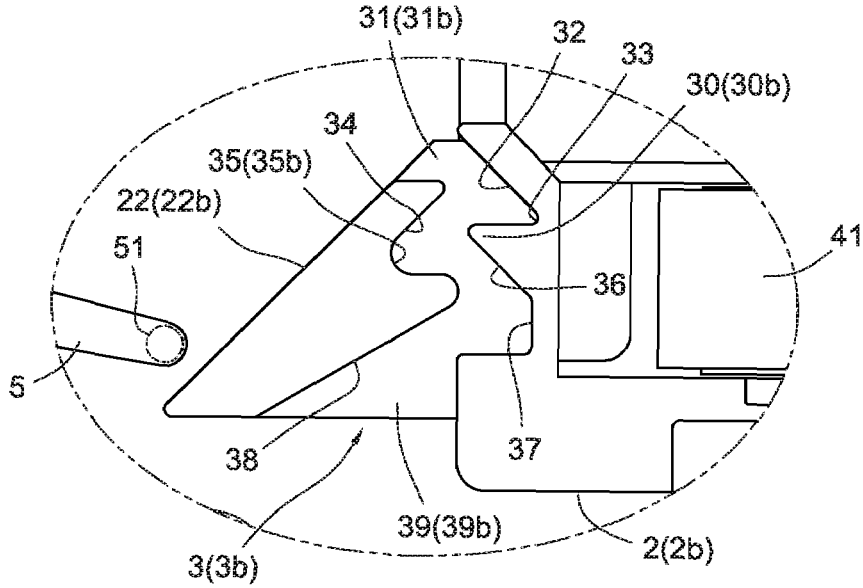
FIG. 4 is a partially enlarged view of the magazine assembly of FIG. 2, showing a locating device of the nail pusher.

According to the above described magazine assembly 1, the nail pusher 2 has at least one M-shaped bended guiding groove 3 (as shown in FIG. 4). The guiding groove 3 has an entrance 31 and an exit 39, opening to a tail end 12 of the magazine assembly 1, and a capturing notch 35 therein, opening to the top end 11 of the magazine assembly 1, and a ridge 30 protruding from an inner sidewall of the guiding groove 3, opposite to the capturing notch 35. In addition, the nail pusher 2 has a guiding flange 22 slantwise extending to the entrance 31.

The magazine assembly 1 has a pivoting base 6 formed at the tail end 12, which has a pivot 61 thereon. A sway arm 5 pivotally connects the pivot 61 through a pivot joint 52 at a tail end thereof, which has at least one circular guiding pole 51 at its top end thereof, corresponding to the guiding flange 22. In this embodiment, one circular guiding pole 51 is provided, which perpendicular extends from the top end of the sway arm 5. A second elastic element 42 is provided between the tail end 12 of the magazine assembly 1 and the sway arm 5, which is a torsion spring in this embodiment used to drive the sway arm 5 to swing and bring the circular guiding pole 51 to move from the entrance 31 toward the exit 39 of the guiding groove 3. The torsion spring wraps around the pivot 61, one end being fixed at the sway arm 5, the other end being nested at one pole 62 formed at the tail end of the magazine assembly 1.

Figure 10:
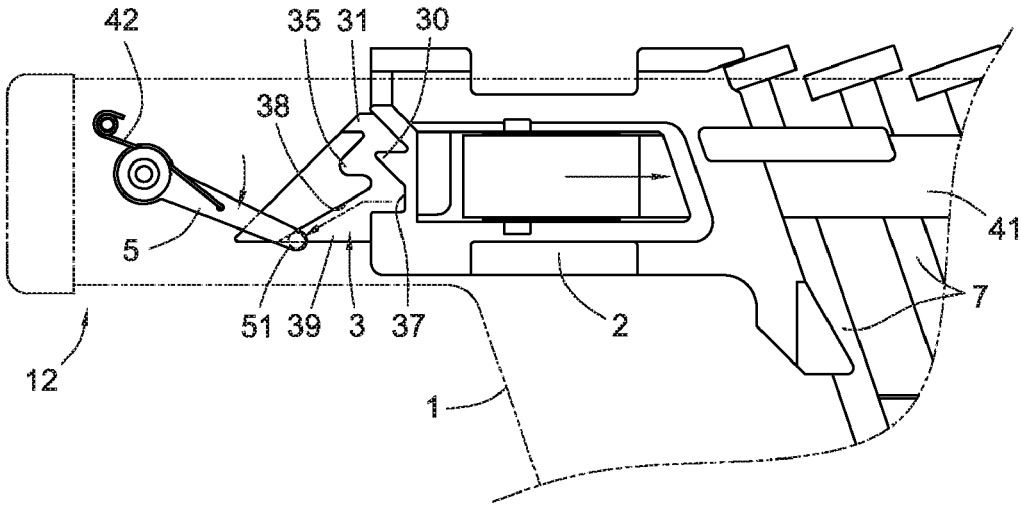
FIG. 10 is a plane view of the magazine assembly showing a sixth operation state.

The second elastic element 42 can further drive the guiding pole 51 of the sway arm 5 to move from the exit 39 toward an adjacent position thereof. The top end 11 of the magazine assembly 1 is an exit where rows of nails 7 are pushed out one by one, into a hitting nose (not shown) in a gun body of the nail gun (as shown in FIG. 1 and FIG. 10). The tail end 12 of the magazine assembly 1 is opposite to the top end 11, at a rear side of the magazine assembly 1, where the nail pusher 2 pushes the fully loaded nails 7.

In further detail description, the first embodiment of the present invention further has following structures. The ridge 30 partitions the inner sidewall of the guiding groove 3 to define a front stopping notch 33 and a rear stopping notch 37, all opening to the tail end 12 of the magazine assembly 1 (as shown in FIG. 2 and FIG. 4).

The front stopping notch 33 has a first slant surface 32 slantways extending to the entrance 31.

The capturing notch 35 has a second slant surface 34 slantways extending to the corresponding front stopping notch 33.

The rear stopping notch 37 has a third slant surface 36 slantways extending to the capturing notch 35.

The exit 39 has a fourth slant surface 38, inward oblique, slantways extending to the corresponding rear stopping notch 37.

The second elastic element 42 actually can drive the guiding pole 51 of the sway arm 5 to move from the entrance 31 of the guiding groove 3 to the fourth slant surface 38.

Figure 5:
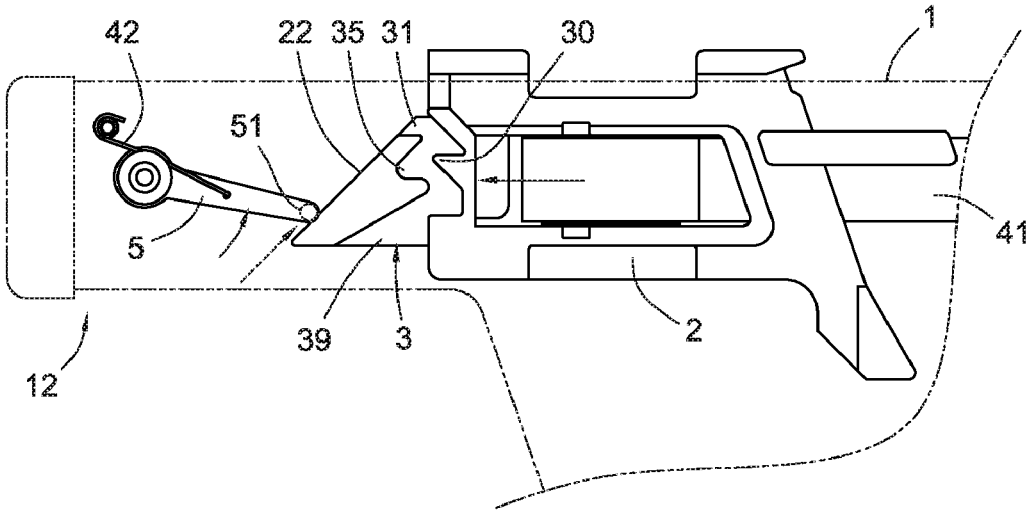
FIG. 5 is a plane view of the magazine assembly showing a first operation state.
Figure 6:
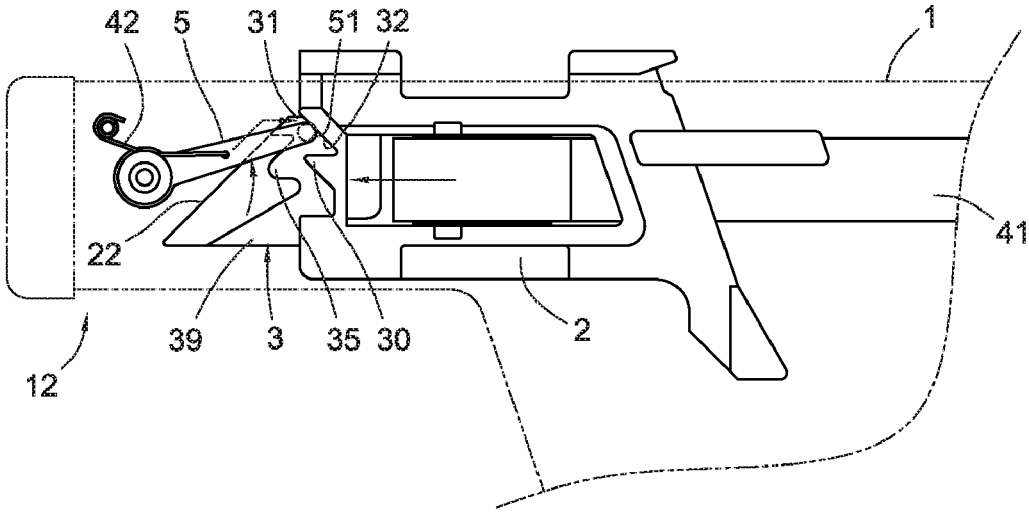
FIG. 6 is a plane view of the magazine assembly showing a second operation state.
Figure 7:
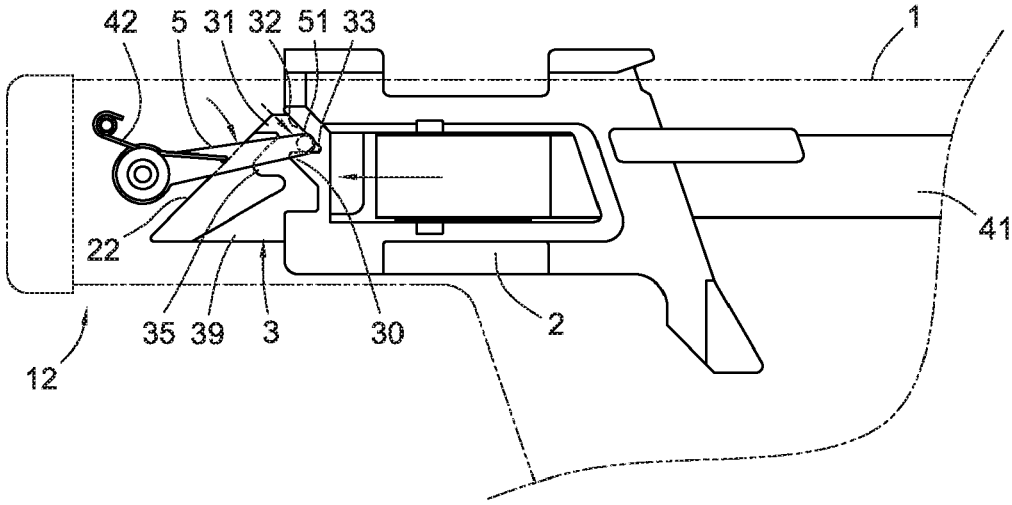
FIG. 7 is a plane view of the magazine assembly showing a third operation state.
Figure 8:
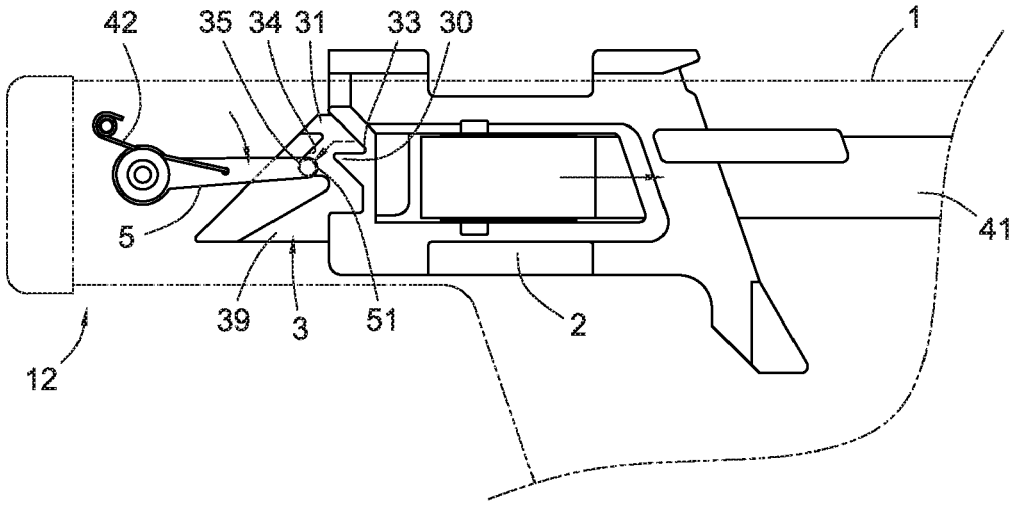
FIG. 8 is a plane view of the magazine assembly showing a fourth operation state.

Through assembling the above described elements, a user can operate it as follows. In use, when a user want to reload rows of nails 7 in the magazine assembly 1, the user can firstly push the nail pusher 2 to the tail end 12 of the magazine assembly 1 (as shown in FIG. 5). When the nail pusher 2 is close to the tail end 12 of the magazine assembly 1, the guiding pole 51 is pushed by the guiding flange 22, to resist the elasticity of the second elastic element 42 and slides into the entrance 31 (as shown in FIG. 6). After that, the elasticity loaded on the guiding pole 51 by the second elastic element 42 drives the sway arm 5 to swing toward the exit 39 and brings the guiding pole 51 to move toward the exit 39. Thus, the guiding pole 51 slides into the front stopping notch 33, at one side of the ridge 30, along the first slant surface 32 (as shown in FIG. 7) for stopping the guiding pole 51. Then, the user can release the nail pusher 2, which makes the nail pusher 2 to be driven to move toward the top end 11 of the magazine assembly 1 by the first elastic element 41 again. Thus, the guiding pole 51 disengages with the front stopping notch 33 and slides into the capturing notch 35 along the second slant surface 34 for locating the nail pusher 2 (as shown in FIG. 8). In which, an opening end of the capturing notch 35 faces the top end 11 of the magazine assembly 1, which makes the moving direction of the nail pusher 2 and the opening end of the capturing notch 35 along a same axis direction. Thus, the guiding pole 51 can be fixed in the capturing notch 35 through the elasticity of the first elastic element 41. Therefore, the stability thereof is improved.

Figure 9:
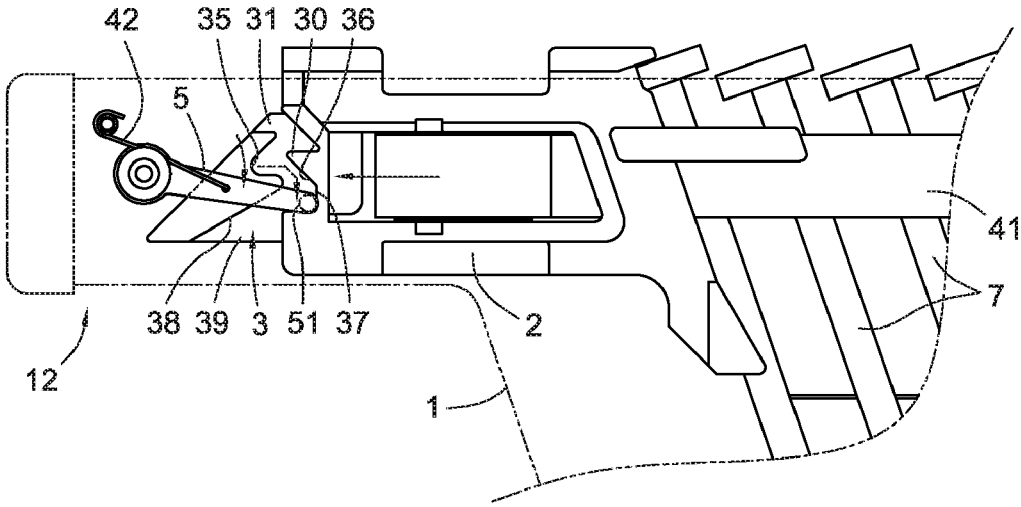
FIG. 9 is a plane view of the magazine assembly showing a fifth operation state.

After the user fully fills the rows of nails 7 therein, the user can further pull the nail pusher 2 to the tail end 12 of the magazine assembly 1 (as shown in FIG. 9). Then, the guiding pole 51 breaks away the capturing notch 35, and the sway arm 5 loads the elasticity of the second elastic element 42, which makes the guiding pole 51 to move toward the exit 39 and slide into the rear stopping notch 37 at another side of the ridge 30, along the third slant surface 36, for stopping the moving of the guiding pole 51. After that, the user can release the nail pusher 2 and let the nail pusher 2 to move toward the top end 11 of the magazine assembly 1 under the elasticity of the first elastic element 41 again. Thus, the guiding pole 51 disengages with the rear stopping notch 37 and slides to the fourth slang surface 38 of the guiding groove 3. At the moment, the second elastic element 42 releases the sway force loaded on the sway arm 5. The first elastic element 41 drives the nail pusher 2 to move toward the top end 11 of the magazine assembly 1 and drives the guiding pole 51 to be pushed by the fourth slant surface 38. Thus, the second elastic element 42 again provides elastic force on the guiding pole 51 to assure the guiding pole 51 to slide along the fourth slant surface 38 to the exit 39 (as shown in FIG. 10). Finally, the guiding pole 51 disengages with the guiding groove 3 and moves to the position corresponding to the slant flange 22 (as shown in FIG. 2). By releasing the elasticity of the second elastic element 42, the nail pusher 2 is released too, and it can push the rows of nails 7 into the hitting nose (not shown) in a gun body of the nail gun one by one.

Figure 11:
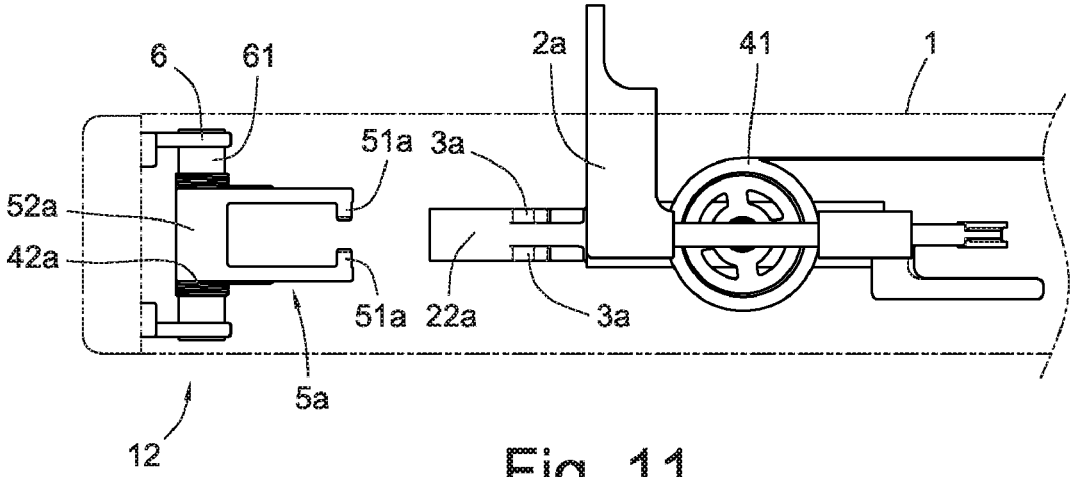
FIG. 11 is an assembly view of a magazine assembly according to a second embodiment of the present invention, having a nail pusher.
Figure 12:
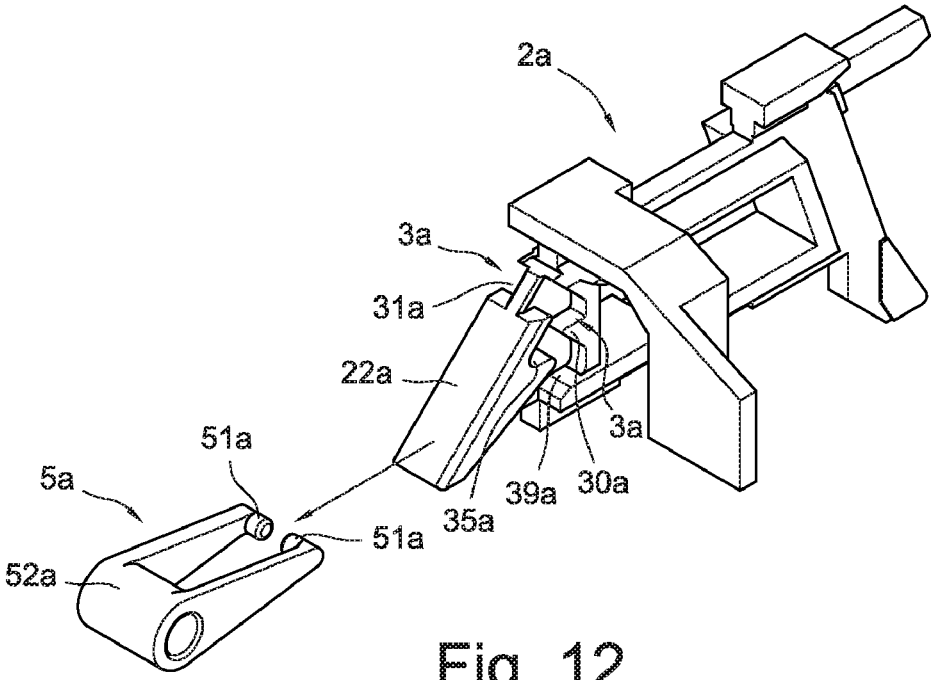
FIG. 12 is a perspective view of the magazine assembly of FIG. 11.

As shown in FIG. 11 and FIG. 12, a second embodiment of the present invention is shown, which discloses the configuration of the present invention can have a plurality of guiding grooves 3 and a plurality of guiding poles 51. Two opposite outer sides of the nail pusher 2*a* respectively have one guiding groove 3*a*. Each guiding groove 3*a* has an entrance 31*a* and an exit 39*a*, opening to a tail end 12 of the magazine assembly 1, and a capturing notch 35*a* therein, opening to the top end 11 of the magazine assembly 1, and a ridge 30*a* protruding from an inner sidewall of the guiding groove 3*a*, opposite to the capturing notch 35*a*. In addition, the nail pusher 2*a* has a guiding flange 22*a* slantwise extending to the entrance 31*a*. A sway arm 5*a* pivotally connects the pivot 61 of the pivot base 6 through a pivot joint 52*a* at a tail end thereof, which has two opposite circular guiding poles 51*a* at its top end thereof, corresponding to the guiding flange 22*a*. A second elastic element 42 is provided between the tail end 12 of the magazine assembly 1 and the sway arm 5*a*, which is a torsion spring in this embodiment used to drive the sway arm 5*a* to swing and bring the circular guiding poles 51*a* to move from the entrance 31*a* toward the exit 39*a* of the guiding groove 3*a*. The other elements are same to those of the first embodiment.

Figure 13:
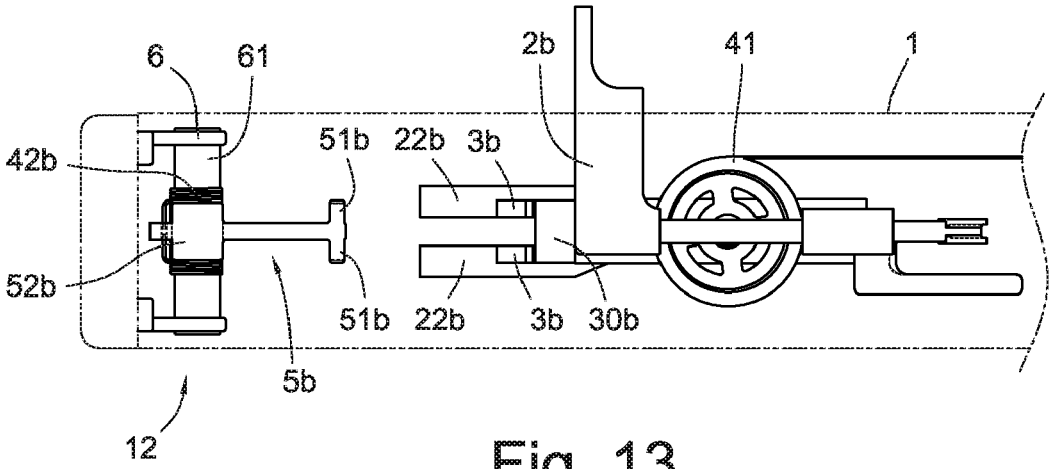
FIG. 13 is an assembly view of a magazine assembly according to a third embodiment of the present invention, having a nail pusher.
Figure 14:
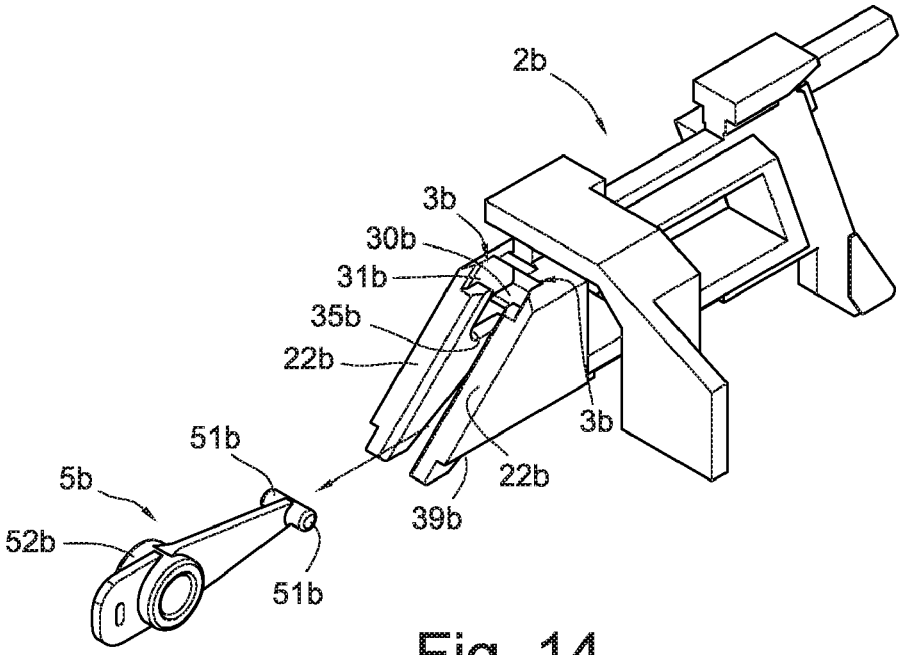
FIG. 14 is a perspective view of the magazine assembly of FIG. 13.

As shown in FIG. 13 and FIG. 14, a third embodiment of the present invention is shown, which discloses the configuration of the present invention can have two opposite guiding grooves 3*b* formed at two opposite inner sides of a nail pusher 2*b*. Each guiding groove 3*b* has an entrance 31*b* and an exit 39*b*, opening to a tail end 12 of the magazine assembly 1, and a capturing notch 35*b* therein, opening to the top end 11 of the magazine assembly 1, and a ridge 30*b* protruding from an inner sidewall of the guiding groove 3*b*, opposite to the capturing notch 35*b*. In addition, the nail pusher 2*b* has a guiding flange 22*b* slantwise extending to the entrance 31*b*. A sway arm 5*b* pivotally connects the pivot 61 of the pivot base 6 through a pivot joint 52*b* at a tail end thereof, which has two opposite circular guiding poles 51*b* at its top end thereof, corresponding to the guiding flange 22*b*. A second elastic element 42 is provided between the tail end 12 of the magazine assembly 1 and the sway arm 5*b*, which is a torsion spring in this embodiment used to drive the sway arm 5*b* to swing and bring the circular guiding poles 51*b* to move from the entrance 31*b* toward the exit 39*b* of the guiding groove 3*b*. The other elements are same to those of the first embodiment.

Figure 15:
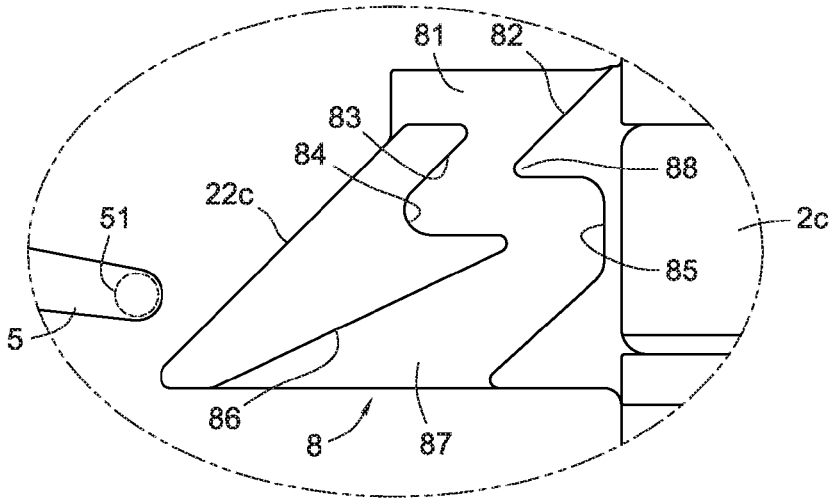
FIG. 15 is an assembly view of a magazine assembly according to a fourth embodiment of the present invention, having a nail pusher.

As shown in FIG. 15, a fourth embodiment of the present invention is shown, which discloses the M-shaped bend guiding groove 3 of the first embodiment can also be N-shaped bend guiding groove 8. The guiding groove 8 has an entrance 81 and an exit 87, opening to a tail end 12 of the magazine assembly 1, and a capturing notch 84 therein, opening to the top end 11 of the magazine assembly 1, and a ridge 88 protruding from an inner sidewall of the guiding groove 8, opposite to the capturing notch 84. The ridge 88 partitions the inner sidewall of the guiding groove 8 to form a stopping notch 85, opening to the tail end 12 of the magazine assembly 1. In addition, the nail pusher 2*c* has a guiding flange 22*c* slantwise extending to the entrance 81. The entrance 81 has a first front slant surface 82, inward oblique, slantways extending to the ridge 88, and a second front slant surface 83, inward oblique, slantways extending to the capturing notch 84. The exit 87 has a rear slant surface 86, inward oblique, slantways extending to the corresponding rear stopping notch 85. The second elastic element 42 drives the guiding pole 51 to move to the corresponding rear slant surface 86. The other elements are same to those of the first embodiment.

Figure 16:
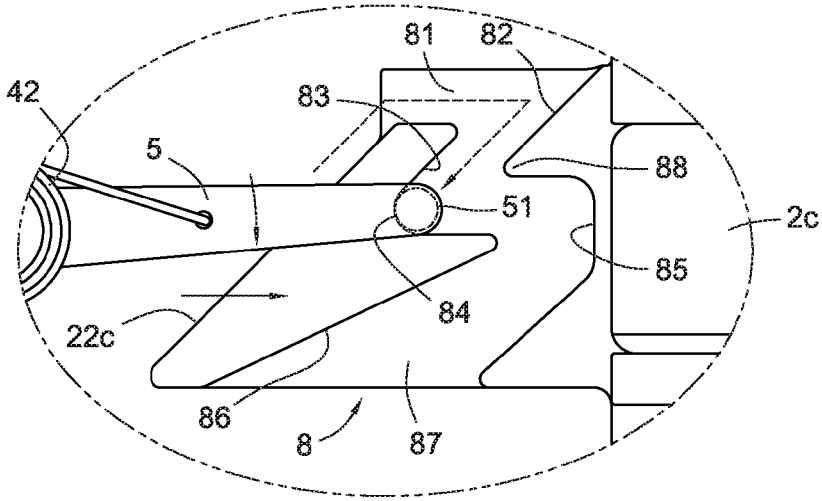
FIG. 16 is a plane view of the magazine assembly of FIG. 15 showing an operation state.
Figure 17:
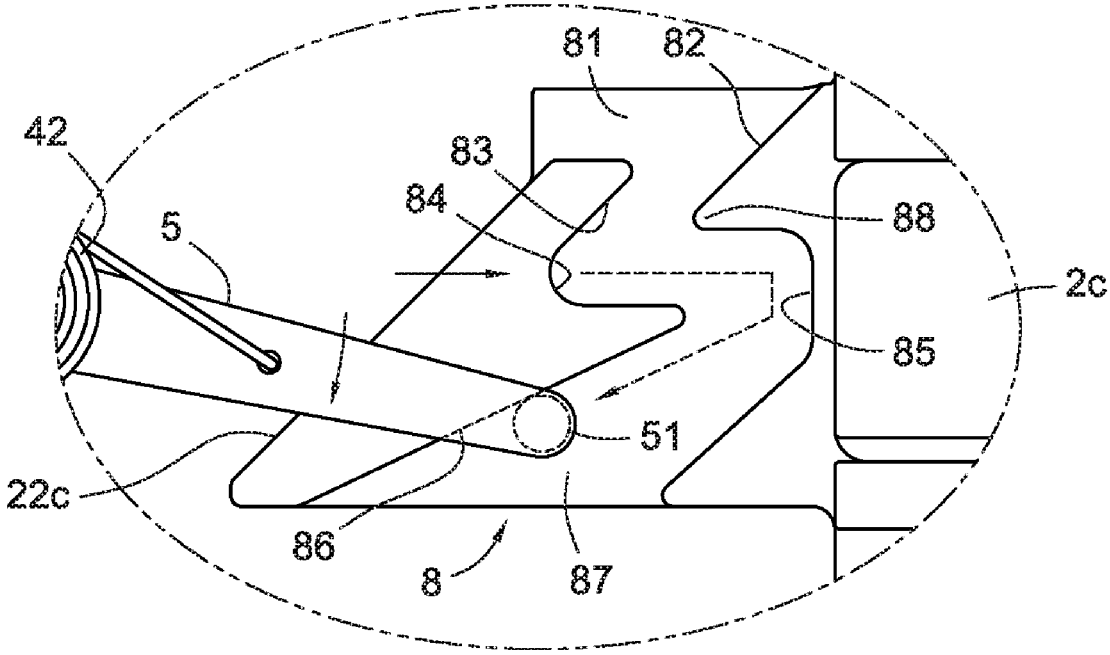
FIG. 17 is a plane view of the magazine assembly of FIG. 15 showing an another operation state.

In use, when a user pushes the nail pusher 2*c* to the tail end 12 of the magazine assembly 1, the guiding pole 51 is pushed by the guiding flange 22*c* and slides into the entrance 81 along the guiding flange 22*c* (as shown in FIG. 16). After that, the user can release the nail pusher 2*c*, which makes the nail pusher 2*c* to be driven to move toward the top end 11 of the magazine assembly 1 by the first elastic element 41. At the same time, the sway arm 5 receives the elasticity of the second elastic element 42 and drives the guiding pole 51 to move toward the exit 87, and makes the guiding pole 51 slide into the capturing notch 84 along the first and the second front slant surfaces 82, 83, for locating the nail pusher 2*c*. After the user fully loads the rows of nails 7 (as shown in FIG. 9), the user can further pull the nail pusher 2*c* to the tail end 12 of the magazine assembly 1. Thus, the guiding pole 51 breaks away the capturing notch 84 and is stopped in the stopping notch 85 (as shown in FIG. 17). After that, the user can release the nail pusher 2*c* and let the nail pusher 2*c* to move toward the top end 11 of the magazine assembly 1 under the elasticity of the first elastic element 41 again. Thus, the guiding pole 51 disengages with the rear stopping notch 85 and slides to the exit 87 under the elasticity loaded on the sway arm 5 by the second elastic element 42. At the moment, the second elastic element 42 releases the sway force loaded on the sway arm 5. The first elastic element 41 drives the nail pusher 2*c* to move toward the top end 11 of the magazine assembly 1 and drives the guiding pole 51 to be pushed by the rear slant surface 86. Thus, the second elastic element 42 again provides elastic force on the guiding pole 51 to assure the guiding pole 51 to slide along the rear slant surface 86 to the exit 87. Finally, the guiding pole 51 disengages with the guiding groove 8 and moves to the position corresponding to the slant flange 22*c*. By releasing the elasticity of the second elastic element 42, the nail pusher 2*c* is released too, and it can push the rows of nails 7 into the hitting nose (not shown) in a gun body of the nail gun one by one.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A nail pusher locating device for a magazine assembly, comprising:

a nail pusher slidingly disposed in the magazine assembly; and a first elastic element between the magazine assembly and the nail pusher for driving the nail pusher to move toward a top end of the magazine assembly;

wherein the nail pusher comprises at least one bended-shaped guiding groove, the guiding groove comprising an entrance, an exit, and a capturing notch, opening to the top end of the magazine assembly, and a ridge protruding from an inner sidewall of the guiding groove, opposite to the capturing notch; the nail pusher further comprises a guiding flange slantwise extending to the entrance;

the magazine assembly comprises a sway arm pivotally disposed at a tail end thereof, which comprises at least one guiding pole corresponding to the guiding flange; and a second elastic element is provided between the tail end and the sway arm, for driving the guiding pole to move from the entrance to the exits, wherein the ridge partitions the inner sidewall of the guiding groove to form a front stopping notch and a rear stopping notch, opening to the tail end of the magazine assembly.

2. The nail pusher locating device as claimed in claim 1, wherein a plurality of guiding grooves are formed at two opposite outer sides of the nail pusher and a plurality of guiding poles are opposite to each other.

3. The nail pusher locating device as claimed in claim 1, wherein a plurality of guiding grooves are formed at two opposite inner sides of the nail pusher and a plurality of guiding poles are opposite to each other.

4. The nail pusher locating device as claimed in claim 1, wherein the front stopping notch comprises a slant surface slantways extending to the entrance.

5. The nail pusher locating device as claimed in claim 1, wherein the capturing notch comprises a slant surface slantways extending to the corresponding front stopping notch.

6. The nail pusher locating device as claimed in claim 1, wherein the rear stopping notch comprises a third slant surface slantways extending to the capturing notch.

7. The nail pusher locating device as claimed in claim 1, wherein the exit comprises a fourth slant surface, inward oblique, slantways extending to the corresponding rear stopping notch.

8. The nail pusher locating device as claimed in claim 7, wherein the second elastic element drives the guiding pole to move to the fourth slant surface.

9. A nail pusher locating device for a magazine assembly, comprising:

a nail pusher slidingly disposed in the magazine assembly; and a first elastic element between the magazine assembly and the nail pusher for driving the nail pusher to move toward a top end of the magazine assembly;

wherein the nail pusher comprises at least one bended-shaped guiding groove, the guiding groove comprising an entrance, an exit, and a capturing notch, opening to the top end of the magazine assembly, and a ridge protruding from an inner sidewall of the guiding groove, opposite to the capturing notch; the nail pusher further comprises a guiding flange slantwise extending to the entrance;

the magazine assembly comprises a sway arm pivotally disposed at a tail end thereof, which comprises at least one guiding pole corresponding to the guiding flange; and a second elastic element is provided between the tail end and the sway arm, for driving the guiding pole to move from the entrance to the exit, wherein the ridge partitions the inner sidewall of the guiding groove to form a stopping notch, opening to the tail end of the magazine assembly.

10. The nail pusher locating device as claimed in claim 9, wherein the entrance comprises a front slant surface, inward oblique, slantways extending to the ridge.

11. The nail pusher locating device as claimed in claim 9, wherein the entrance comprises a front slant surface, inward oblique, slantways extending to the capturing notch.

12. The nail pusher locating device as claimed in claim 9, wherein the exit has a rear slant surface, inward oblique, slantways extending to the corresponding rear stopping notch.

13. The nail pusher locating device as claimed in claim 12, wherein the second elastic element drives the guiding pole to move to the corresponding rear slant surface.

* * * * *